US006925758B2

(12) United States Patent
Pettit

(10) Patent No.: US 6,925,758 B2
(45) Date of Patent: Aug. 9, 2005

(54) FORCED ENTRY RESISTANCE DEVICE FOR SASH WINDOW ASSEMBLY

(75) Inventor: Dean Pettit, St. John, IN (US)

(73) Assignee: Newell Operating Company, Freeport, IL (US)

( * ) Notice: Subject to any disclaimer, the term of this patent is extended or adjusted under 35 U.S.C. 154(b) by 0 days.

(21) Appl. No.: 10/430,803

(22) Filed: May 6, 2003

(65) Prior Publication Data

US 2004/0221513 A1 Nov. 11, 2004

(51) Int. Cl.[7] ..... E05B 1/00
(52) U.S. Cl. ..... 49/460; 49/449; 292/346
(58) Field of Search ..... 49/183, 449, 460, 49/462; 70/416, 417, 418, 89, 90; 292/DIG. 20, 346, 240, 241, 242

(56) References Cited

U.S. PATENT DOCUMENTS

| | | | |
|---|---|---|---|
| 115,781 | A | 6/1871 | Steele |
| 201,146 | A | 3/1878 | Adler |
| 215,125 | A | 5/1879 | Hunter |
| 234,387 | A | 11/1880 | Burgess et al. |
| 284,993 | A | 9/1883 | Abele |
| 336,302 | A | 2/1886 | Dudgeon |
| 353,287 | A | 11/1886 | Chumard |
| 480,148 | A | 8/1892 | Theby |
| 564,426 | A | 7/1896 | Hubbard |
| 743,716 | A | 11/1903 | Hadka |
| 744,755 | A | 11/1903 | Hasenpflug |
| 756,559 | A | 4/1904 | Arens |
| 878,206 | A | 2/1908 | Johnson |
| 900,079 | A | 10/1908 | Bittorf |
| 910,850 | A | 1/1909 | Petrie |
| 928,408 | A | 7/1909 | Taube |
| 1,041,803 | A | 10/1912 | Kilburn |
| 1,059,999 | A | 4/1913 | James et al. |

(Continued)

FOREIGN PATENT DOCUMENTS

| | | |
|---|---|---|
| GB | 341207 | 1/1931 |
| GB | 2 026 594 A | 2/1980 |

OTHER PUBLICATIONS

Page 21, Home Protection Hardware Catalog Price List, dated Jul. 1986.

*Primary Examiner*—Jerry Redman
(74) *Attorney, Agent, or Firm*—Wallenstein Wagner & Rockey, Ltd.

(57) ABSTRACT

A forced entry resistance device (20) is provided for a sash window assembly (10). The assembly has a keeper (28) mounted on a base (25) of an upper sash window (14) and a locking assembly (30) mounted on a top rail (27) of a lower sash window (16). The locking assembly (30) has a movable cam (36) for engaging the keeper (28). The forced entry resistance device (20) comprises a member (20) adapted to be mounted to one of the base (25) and top rail (27) for preventing access to the cam (36).

7 Claims, 3 Drawing Sheets

U.S. PATENT DOCUMENTS 1,122,026 A 12/1914 O'Rourke
1,148,712 A 8/1915 Overand
1,156,004 A 10/1915 Fuller
1,247,182 A 11/1917 Tueckmantel
1,253,810 A 1/1918 Gianninoto
1,338,250 A 4/1920 Parkes
1,338,416 A 4/1920 Bellinger
1,339,362 A 5/1920 L'Heureux
1,393,628 A 10/1921 Leichter
1,550,532 A 8/1925 French
1,692,579 A 11/1928 Schrader
1,704,946 A 3/1929 Lindgren
1,790,816 A 2/1931 Hiering
1,900,936 A 3/1933 Huttger
1,901,974 A 3/1933 Macy
2,537,736 A 1/1951 Carlson
2,605,125 A 7/1952 Emerson
2,758,862 A 8/1956 Endter
3,027,188 A 3/1962 Eichstadt
3,135,542 A 6/1964 Wilkinson
3,377,093 A 4/1968 Macoicz
3,405,962 A * 10/1968 Sushan ..... 292/346
3,438,153 A 4/1969 Lemme
3,645,573 A 2/1972 Strang
3,655,230 A 4/1972 Armstrong
3,706,467 A 12/1972 Martin
3,709,540 A 1/1973 Beilis
3,811,718 A 5/1974 Bates
3,907,348 A 9/1975 Bates
4,059,298 A 11/1977 Van Klompenburg
4,095,827 A 6/1978 Stavenau
4,095,829 A 6/1978 Van Klompenburg
4,102,546 A * 7/1978 Costello ..... 292/346
4,130,311 A * 12/1978 Sushan ..... 292/346
4,223,930 A * 9/1980 Costello et al. ..... 292/346
4,227,345 A 10/1980 Durham, Jr.
4,235,465 A * 11/1980 Costello ..... 292/346
4,261,602 A 4/1981 Anderson
4,305,612 A 12/1981 Hunt et al.
D268,643 S 4/1983 Anderson
4,558,174 A 12/1985 Massey
4,621,847 A 11/1986 Paulson
4,736,972 A 4/1988 Mosch
4,801,164 A 1/1989 Mosch
4,813,725 A 3/1989 Mosch
D302,651 S 8/1989 Mosch
4,961,286 A 10/1990 Bezubic
D316,509 S 4/1991 Nolte
5,042,855 A 8/1991 Bennett et al.
5,072,464 A 12/1991 Draheim et al.
5,076,015 A 12/1991 Manzalini
5,087,087 A 2/1992 Vetter
5,087,088 A 2/1992 Milam
5,090,750 A 2/1992 Lindqvist
5,110,165 A 5/1992 Piltingsrud
5,127,685 A 7/1992 Dallaire et al.
5,139,291 A 8/1992 Schultz
5,161,839 A 11/1992 Piltingsrud et al.
5,219,193 A 6/1993 Piltingsrud
5,398,447 A 3/1995 Morse
5,448,857 A 9/1995 Stormo
D366,409 S 1/1996 Delaske
5,582,445 A 12/1996 Olsen et al.
RE35,463 E 2/1997 Vetter et al.
5,715,631 A 2/1998 Kailian et al.
5,741,032 A 4/1998 Chaput
5,778,602 A 7/1998 Johnson
5,839,767 A 11/1998 Piltingsrud
5,901,499 A 5/1999 Delaske et al.
5,992,907 A 11/1999 Sheldon et al.
6,116,665 A 9/2000 Subliskey
6,142,541 A 11/2000 Rotondi
6,406,076 B1 * 6/2002 Zarzycki, Jr. ..... 292/346
2001/0005995 A1 7/2001 Subliskey
2002/0116874 A1 8/2002 Marshik

* cited by examiner

FORCED ENTRY RESISTANCE DEVICE FOR SASH WINDOW ASSEMBLY

TECHNICAL FIELD

This invention relates to a forced entry resistance device for slidable door or window assemblies. More particularly, it relates to a forced entry resistance plate for a sash window assembly.

BACKGROUND OF THE INVENTION

Slidable door and window assemblies are commonly known in the art. The assemblies typically have a slidable member within a master frame. A double hung window assembly generally has an upper sash window and a lower sash window within a master frame. A sash lock is commonly provided to lock the window assembly. Typical sash locks draw opposed frame members of the sash windows together and lock the sashes preventing them from sliding within the master frame.

One problem associated with typical double hung window assemblies and sash locks, in particular, is they can be manipulated by an intruder from outside the window assembly. Sash locks generally include some type of rotatable actuator arm and cam assembly. The actuator is rotatable between unlocked and locked positions to rotate the cam between unlocked and locked positions. With some sash locks, the actuator arm or cam may be manipulated from the outside by a skilled intruder using a thin knife, stiff wire, or other diabolical tool of intrusion.

The present invention is provided to solve these and other problems.

SUMMARY OF THE INVENTION

The present invention provides a forced entry resistance device for slidable door or window assemblies.

Accordingly, a forced entry resistance device is provided for a sash window assembly. The assembly has a keeper mounted on a base and a locking assembly mounted on a top rail. The locking assembly has a movable cam for engaging the keeper. The forced entry resistance device comprises a member adapted to be mounted to one of the base and top rail for preventing access to the cam.

In accordance with one aspect of the invention, the member comprises a plate.

According to another aspect of the invention, the plate has a lip extending generally away from the plate.

According to another aspect of the invention, the lip is integral with the plate.

According to another aspect of the invention, the lip is generally transverse to the plate.

According to another aspect of the invention, the lip extends across a gap formed between the base and the top rail when the base and top rail are in opposed relation to one another.

According to another aspect of the invention, the lip extends past the gap.

According to another aspect of the invention, the plate is mounted to the base and the lip extends past a plane generally defined by a vertical face of the top rail.

According to another aspect of the invention the plate is mounted to the top rail and the lip extends past a plane generally defined by a vertical face of the base.

According to another aspect of the invention, the member is integral with one of the base or top rail.

According to another aspect of the invention, the member comprises a protrusion adapted to extend past a gap formed by the base and the top rail when the base and the top rail are in opposed relation to one another.

According to another aspect of the invention, the plate is positioned within a gap formed by the base and the top rail when the base and the top rail are in opposed relation to one another and wherein the plate has a thickness, at least a portion of which is sufficient to substantially fill the gap.

Other features and advantages of the invention will be apparent from the following specification including the following drawings.

DETAILED DESCRIPTION

Figure 1:
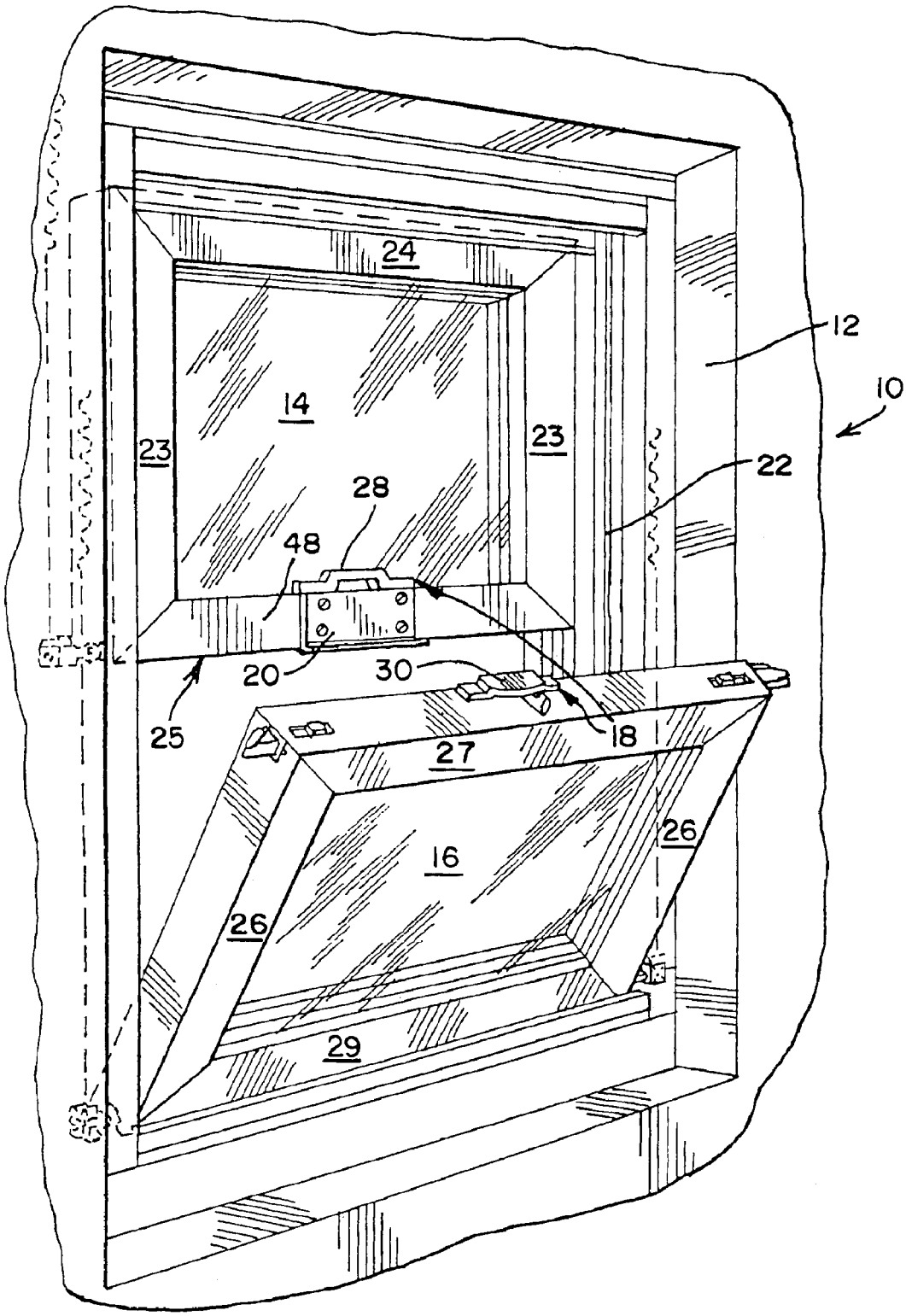
FIG. 1 is a perspective view of a sash window assembly.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A sash window assembly 10 is illustrated in FIG. 1. The sash window assembly 10 generally includes a master frame 12, an upper sash window 14, a lower sash window 16, a sash lock assembly 18 and a forced entry resistance device 20. Other hardware may also be included such as tilt-latches and sash balance brake assemblies.

The upper sash window 14 and the lower sash window 16 are both mounted within opposed guide rails 22 on the master frame 12. The upper sash window 14 has a pair of vertical stiles 23, a top rail 24 and a base 25. The lower sash window 16 has a pair of vertical stiles 26, a top rail 27 and a base 29. In the embodiment shown, both the upper sash window 14 and the lower sash window 16 slide vertically within the master frame 12. However, it is understood that only one of the upper sash 14 or lower sash 16 may be slidable within the master frame 12.

Figure 2:
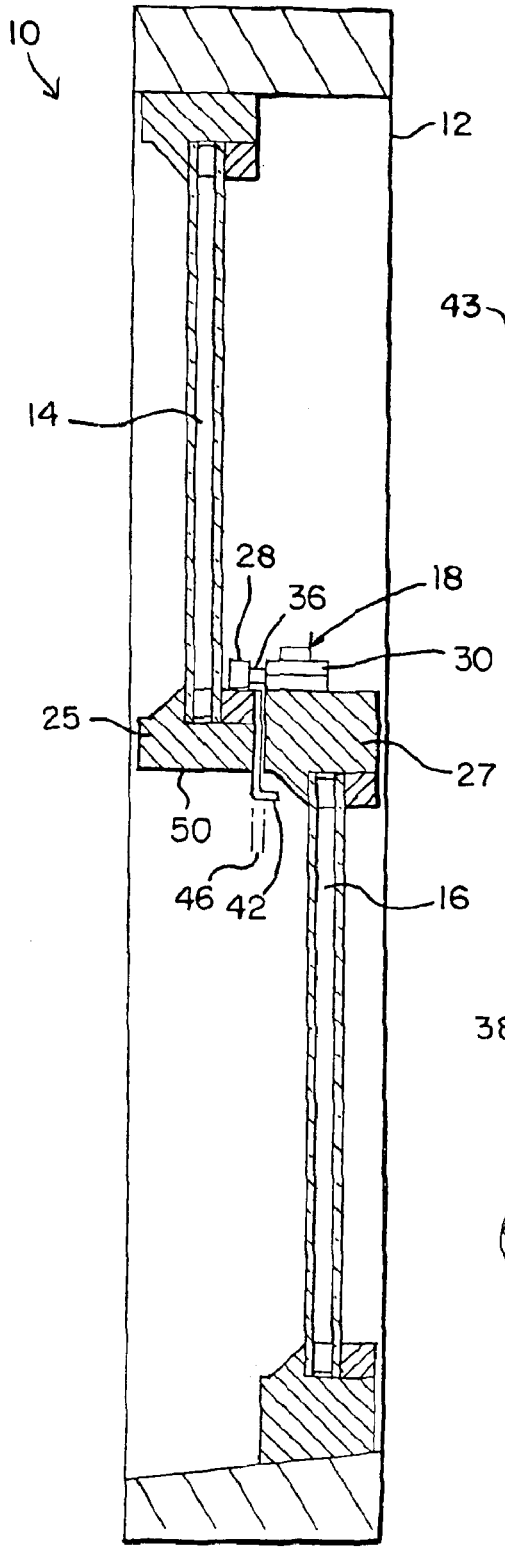
FIG. 2 is a cross sectional view of the sash window assembly, showing one embodiment of the present invention.
Figure 5:
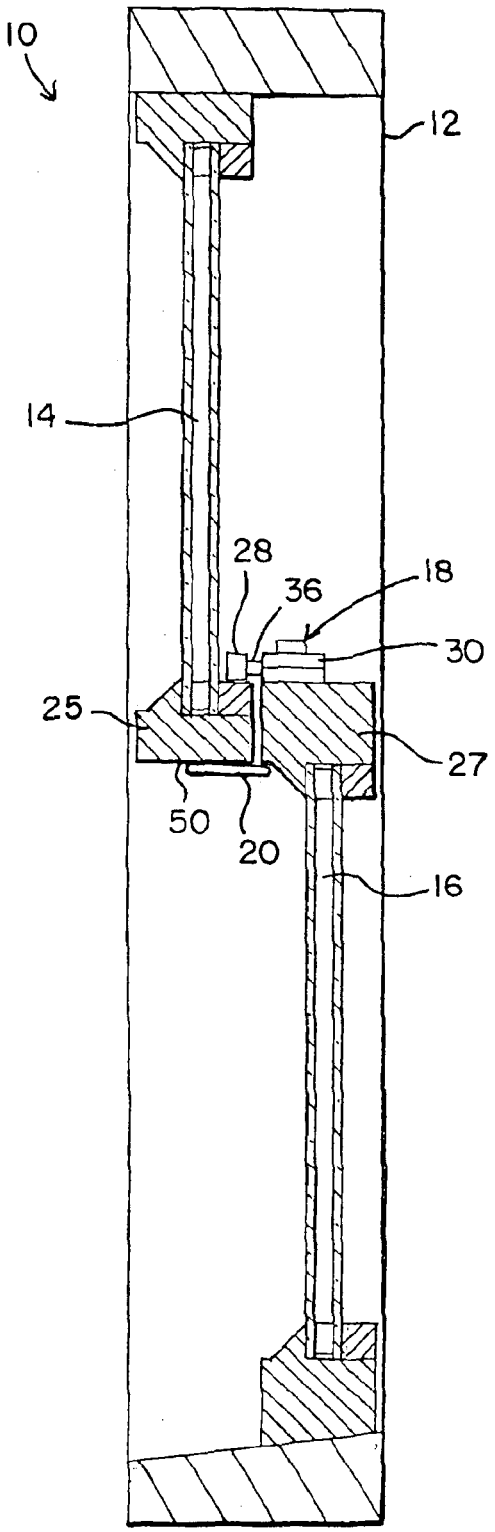
FIG. 5 is a cross sectional view of a sash window assembly, similar to FIG. 2, depicting an additional embodiment of the present invention.

When the upper sash window 14 is in its upper most position and the lower sash window 16 is in its lower most position (FIGS. 2, 5 & 6), the base 25 of the upper sash 14 and the top rail 27 of the lower sash 16 are generally in opposed relation to one another. In this position, the base 25 and the top rail 27 typically define a gap 46 (FIG. 2). It may be that the gap 46 is negligible or non-existent. However, even in this instance, there usually remains enough play between the base 25 and the top rail 27 to allow a thin tool to be inserted between the base 25 and the top rail 27.

Figure 4:
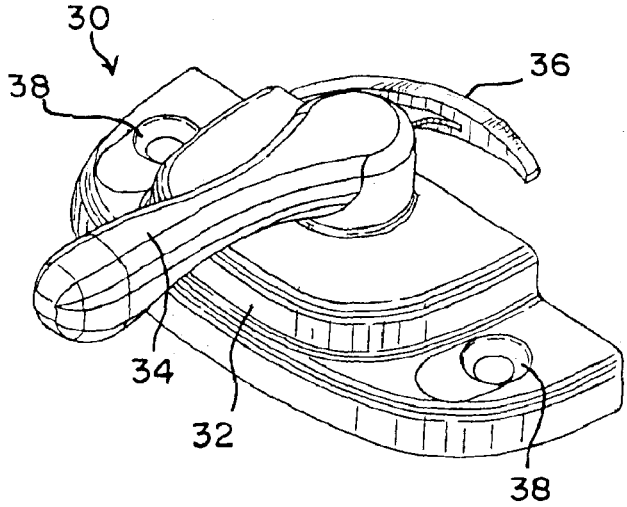
FIG. 4 is a perspective view of a locking assembly of a sash lock assembly.

As further shown in FIGS. 1–2 and 4, the sash lock 18 generally comprises a keeper 28 and a locking assembly 30.

The keeper 28 includes a keeper surface (not shown) and a pair of mount holes (not shown) for mounting the keeper 28 to the base 25.

The locking assembly 30 is mounted to the top rail 27 and is also shown in FIG. 4. The locking assembly 30 generally comprises a housing 32, an actuator arm 34, and a cam 36. A shaft (not shown) connects the cam 36 to the actuator arm 34. The housing 32 includes a pair of mount holes 38 for mounting to the top rail 27. The cam 36 is movable by rotation of the actuator arm 34, for engaging the keeper 28. By engagement of the keeper 28 by the cam 36, the sash lock 18 locks the sashes 14, 16 together and prevents sliding movement of the sashes 14, 16 relative to one another. This prevents opening of the window assembly 10.

Figure 3:
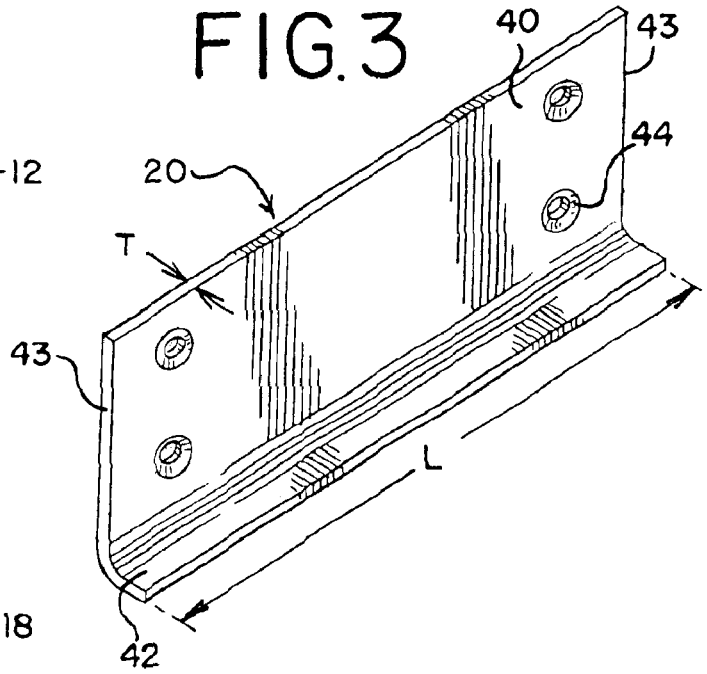
FIG. 3 is a perspective view of an embodiment of the present invention.

The forced entry resistance device or member 20, an embodiment of which is shown in FIG. 3, comprises a generally flat plate 40 having a lip 42 extending from the generally flat plate 40. The generally flat plate 40 is adapted for mounting to the bottom rail 25 of the upper sash window 14 and includes mount holes 44 for this purpose. In one preferred embodiment, the member 20 is mounted by screws. It is understood that other fasteners are possible including adhesives or other fasteners.

In the embodiment shown, the flat plate 40 is mounted to an inner vertical surface or face 48 (FIG. 1) of the base 25. Of course it is understood that the plate 40 may be mounted in a recess (not shown) of the base 25. With the upper sash window 14 in its upper most position and the lower sash window 16 in its lower most position, the lip 42 (FIGS. 2,5 & 6) extends towards the lower sash window 16 sufficiently far enough to obstruct or block access to the small gap 46 by a thin diabolical tool of intrusion. This generally prevents access to the cam 36 by an intruder. Additionally, the flat plate 40 has a length L sufficient to impede an intruder's attempts at inserting a thin diabolical tool of intrusion into the gap 46 from past an end 43 of the plate 40 and manipulating the cam 36.

Although the invention has been described as being applied to a vertically sliding double hung window, it is understood the invention can equally be applied to horizontally sliding sash window arrangements or any operable sash that slides within a frame.

Figure 6:
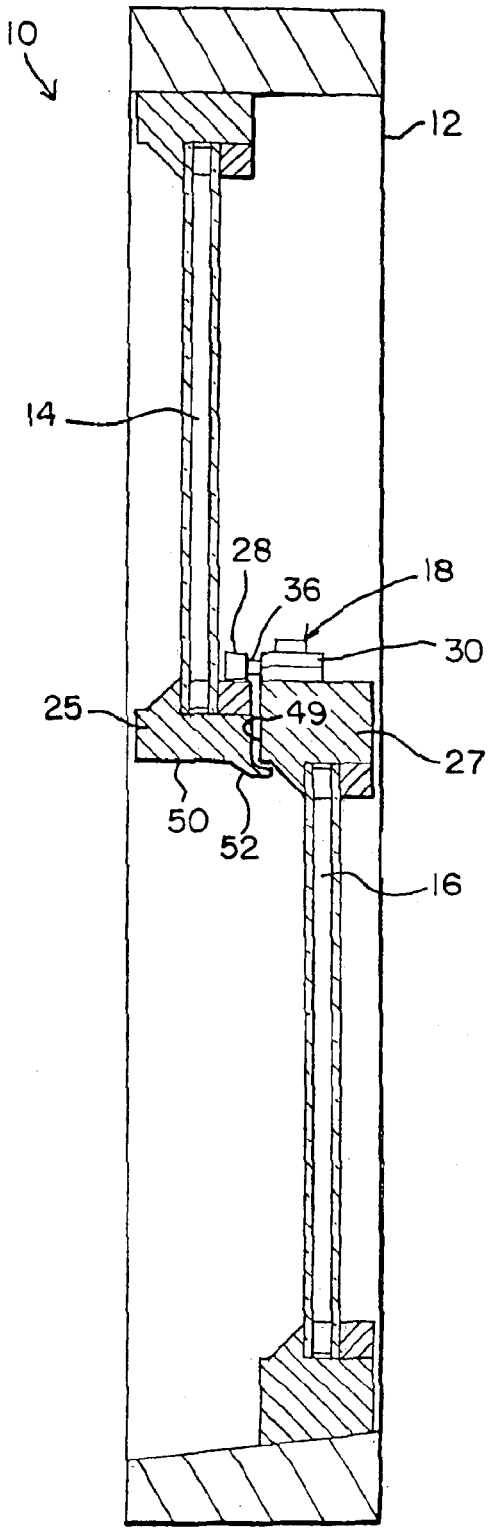
FIG. 6 is a cross sectional view of a sash window assembly, similar to FIG. 2, depicting a further embodiment of the present invention.

Additionally, it will be understood by those of ordinary skill in the art, the forced entry resistance device 20 may be integrally formed with the base 25 while remaining within the scope of the invention, an embodiment of which is depicted in FIG. 6.

Additionally, it will be understood that the forced entry resistance device 20 may be mounted to either the base 25 or the top rail 27.

It is also understood that the forced entry resistance device 20 may take other forms. For example, the forced entry resistance device 20 may comprise a generally flat plate mounted on an underside 50 of the base 25 (FIG. 5), where a portion of the generally flat plate extends past the small gap 46. Also, the forced entry resistance device 20 may comprise a protrusion 52 (FIG. 6) mounted to either the base 25 or top rail 27, where the protrusion 52 extends across the small gap 46. This protrusion 52 may be integrally formed within either the base 25 or top rail 27. In addition, the forced entry resistance device 20 may comprise a generally flat plate mounted to the inside surface 48 of the base 25 where the thickness "T" of the generally flat plate is sufficient to substantially fill the small gap 46, thereby preventing access to the cam 36 via the gap 46. Of course, in this case as with other embodiments, the forced entry resistance device 20 may be mounted to an outer surface or face 49 of the top rail 27.

Furthermore, it is understood that the member 52 or the lip 42 of the present invention may comprise a plurality of shapes and sizes which prevent access to the small gap 46 and therefore the cam 36. These alternatives, as well as others, remain within the scope of this invention.

Moreover, it is understood that the forced entry resistance device 20 may be formed from any number of materials of sufficient strength to withstand the forces involved in an attempted manipulation by an intruder. For example, the forced entry resistance device 20 may be formed from various commonly known metals and alloys or hardened plastics possessing the required strength.

It can be appreciated that the forced entry resistance device 20 of the present invention will assist in preventing simple rotation of the cam 36. The forced entry resistance device 20, while not intruder-proof, will provide significant deterrence to forced entry and uninvited manipulation of the sash lock assembly 18 from outside the sash window assembly 10. It can further be appreciated that the forced entry resistance device 20 may be adapted for retrofitting to existing sash window assemblies 10 currently in use.

While the specific embodiments and various details thereof have been illustrated and described, numerous modifications come to mind without significantly departing from the spirit and the scope of protection limited by the following claims.

What is claimed is:

1. A sash window assembly comprising:

a master frame;

an upper sash window mounted within the master frame and having a base;

a lower sash window mounted within the master frame having a top rail;

a sash lock assembly comprising:

a keeper mounted on the base; and a locking assembly mounted to the top rail, the locking assembly having a movable cam for engaging the keeper; and a plate mounted to an inner vertical face of the base, wherein the plate has an integral lip extending transverse therefrom, the lip further extending across a gap formed between the base and the top rail when the base and the top rail are in opposed relation to one another for preventing access to the cam;

wherein at least one of the upper sash window or lower sash window is slidable within the waster frame.

2. The sash window assembly of claim 1 wherein the plate is mounted to the base and the lip extends past a plane generally defined by a vertical face of the top rail.

3. The sash window assembly of claim 1 wherein the plate is integral with one of the base or top rail.

4. The sash window assembly of claim 1, wherein the plate is positioned within a gap formed by the base and the top rail when the base and the top rail are in opposed relation to one another, and wherein the plate has a thickness, at least a portion of which is sufficient to substantially fill the gap.

5. A sash window assembly comprising:

a master frame;

an upper sash window mounted within the master frame and having a base with an inner vertical face;

a lower sash window mounted within the master frame having a rail, a gap defined between the base and rail when the base and rail are in opposed relation to one another, a sash lock assembly comprising:

a keeper mounted on the base; and a locking assembly mounted to the top rail, the locking assembly having a movable cam for engaging the keeper; and a plate mounted to the inner vertical face of the base, the plate having an integral lip extending away from the plate and across the gap.

6. A sash window assembly comprising:

a master frame;

an upper sash window mounted within the master frame and having an upper base with an inner vertical face;

a lower sash window mounted within the master frame having a top rail and a lower base, a gap defined between the upper base and top rail when the upper base and top rail are in opposed relation to one another;

a sash lock assembly comprising a keeper mounted on the upper base and a locking assembly mounted to the top rail, the locking assembly having a movable cam for engaging the keeper; and a plate mounted to the inner vertical face of the upper base and extending from the face, wherein the plate substantially fills the sap, the plate having an integral lip extending transverse to the plate, the lip located between the top rail and the lower base of the lower sash.

7. A sash window assembly comprising:

a master frame;

an upper sash window mounted within the master frame and having a base with an inner vertical face and an underside;

a lower sash window mounted within the master frame having a top rail, a gap defined between the base of the upper sash and the top rail of the lower sash when the base and top rail are in opposed relation to one another;

a sash lock assembly comprising a keeper mounted on the base of the upper sash and a locking assembly mounted to the top rail of the lower sash, the locking assembly having a movable cam for engaging the keeper, and a plate mounted to the underside of the base of the upper sash, wherein a portion of the plate extends across the gap preventing access to the sash lock assembly.

* * * * *

UNITED STATES PATENT AND TRADEMARK OFFICE

CERTIFICATE OF CORRECTION

PATENT NO. : 6,925,758 B2
DATED : August 9, 2005
INVENTOR(S) : Dean Pettit

It is certified that error appears in the above-identified patent and that said Letters Patent is hereby corrected as shown below:

Column 4,
Line 49, "waster" should be -- master --.

Signed and Sealed this

Twenty-seventh Day of December, 2005

JON W. DUDAS
*Director of the United States Patent and Trademark Office*